US010481556B2

(12) United States Patent
Buttet et al.

(10) Patent No.: US 10,481,556 B2
(45) Date of Patent: Nov. 19, 2019

(54) TIME-KEEPING MOVEMENT COMPRISING A REGULATOR WITH THREE-DIMENSIONAL MAGNETIC RESONANCE

(71) Applicant: HUBLOT SA, GENEVE, Geneva (CH)

(72) Inventors: Mathias Buttet, Monnaz (CH); Jean-Michel Blumenthal, Chavannes-des-Bois (CH)

(73) Assignee: HUBLOT SA, GENEVE, Geneva (CH)

( * ) Notice: Subject to any disclaimer, the term of this patent is extended or adjusted under 35 U.S.C. 154(b) by 0 days.

(21) Appl. No.: 15/554,546

(22) PCT Filed: Mar. 1, 2016

(86) PCT No.: PCT/EP2016/054300
§ 371 (c)(1),
(2) Date: Aug. 30, 2017

(87) PCT Pub. No.: WO2016/139196
PCT Pub. Date: Sep. 9, 2016

(65) Prior Publication Data

US 2018/0074459 A1 Mar. 15, 2018

(30) Foreign Application Priority Data

Mar. 4, 2015 (CH) ..... 292/15

(51) Int. Cl.
*G04B 17/06* (2006.01)
*G04B 17/28* (2006.01)
(Continued)

(52) U.S. Cl.
CPC ..... *G04B 17/06* (2013.01); *G04B 17/02* (2013.01); *G04B 17/063* (2013.01); *G04B 17/28* (2013.01); *G04C 3/04* (2013.01)

(58) Field of Classification Search
CPC ..... G04B 17/06; G04B 17/063; G04B 17/28; G04B 17/285; G04C 3/042; G04C 3/045; G04C 3/047; G04C 3/06; G04C 3/064
See application file for complete search history.

(56) References Cited

U.S. PATENT DOCUMENTS 2,616,681 A 11/1952 Morrow
3,183,426 A * 5/1965 Haydon ..... G04C 5/005 368/132
(Continued)

FOREIGN PATENT DOCUMENTS

CH 698 622 B1 9/2009
CH 704 063 A1 5/2012
(Continued)

OTHER PUBLICATIONS

International Search Report and Written Opinion dated Jun. 6, 2016 issued in corresponding application No. PCT/EP2016/054300; w/ English machine translation (22 pages).

*Primary Examiner* — Daniel P Wicklund
(74) *Attorney, Agent, or Firm* — Westerman, Hattori, Daniels & Adrian, LLP

(57) ABSTRACT

An oscillating regulator for a timepiece includes at least two resonant oscillating systems (20, 30), each one having at least one magnetic component (25, 35) suitable for exchanging magnetic energy between the oscillating systems during their oscillations. The shafts (22, 32) of at least two of the oscillating systems (20, 30) differ substantially from each other in terms of their respective orientation.

17 Claims, 3 Drawing Sheets

(51) Int. Cl.
*G04B 17/02* (2006.01)
*G04C 3/04* (2006.01)

(56) References Cited

U.S. PATENT DOCUMENTS

| | | | | |
|---|---|---|---|---|
| 3,877,215 | A | 4/1975 | Burckhardt et al. | |
| 2010/0097899 | A1 | 4/2010 | Greubel et al. | |
| 2012/0113767 | A1* | 5/2012 | Marechal ..... | G04B 31/02<br>368/287 |
| 2013/0215723 | A1 | 8/2013 | Forsey et al. | |

FOREIGN PATENT DOCUMENTS

| | | | |
|---|---|---|---|
| EP | 1 640 821 | A1 | 3/2006 |
| EP | 2 615 504 | A1 | 7/2013 |
| FR | 2210787 | A1 | 7/1974 |
| WO | 2008/101802 | A2 | 8/2008 |
| WO | 2011/058157 | A1 | 5/2011 |
| WO | 2014/180767 | A1 | 11/2014 |

* cited by examiner

TIME-KEEPING MOVEMENT COMPRISING A REGULATOR WITH THREE-DIMENSIONAL MAGNETIC RESONANCE

The present invention relates to an oscillating regulator for a timepiece, and to a clockwork assembly integrating such a regulator. It therefore also relates to a timepiece movement and to a timepiece as such incorporating such a regulator, and in particular to a watch, such as a wristwatch, as such incorporating such a regulator.

PRIOR ART

The accuracy of a conventional mechanical watch largely depends on the operation of its regulator. This regulator generally takes the form of an oscillating system, most frequently comprising a balance wheel/hairspring assembly or a pendulum. This oscillating system exhibits a specific and stable operating frequency, which is used to dictate a controlled time measurement to the watch. It is linked to an energy accumulator, such as a barrel, which delivers power to an escapement via a wheel train. The escapement subsequently periodically transmits pulses to the oscillating system so as to sustain the oscillations thereof over a long period. The system for distributing power to the oscillating system is designed to sustain the oscillating movements without disrupting them.

The operation of such a regulator of the prior art is nonetheless not perfect, due to the intrinsic imperfections of the oscillating system and/or of the power distribution system associated therewith, which cause the operation thereof to deviate from a theoretical ideal operation. Moreover, the regulator is also subject to the effect of the force of gravity, which may vary if the orientation of the regulator changes, as is the case with a wristwatch. These various phenomena lead to a loss of accuracy of the time measurement of a timepiece.

In order to overcome some of these drawbacks, certain solutions depend on complex mechanical systems. For example, with regard to decreasing the effect of gravity, solutions exist, in particular, on the basis of a tourbillon, the principle of which is to set the regulator in motion about one or more axes of rotation so that ultimately the overall movement thereof is less dependent on the orientation thereof. These complex solutions are very expensive and improving the accuracy of the regulator on the basis of an oscillating system is achievable only by developing a complex mechanical system, which is not straightforward.

Other solutions for improving the accuracy of the measurement of time by a regulator on the basis of an oscillating system have been proposed, such as that described by way of example in document EP1640821. This document describes a timepiece movement using a plurality of balance wheels operating in resonance. This principle theoretically allows defects of a single balance wheel to be negated and overall improved time measurement to be obtained, since the potential various defects of each balance wheel are supposedly compensated for by the other balance wheels, which will probably not exhibit the same defects at the same time. The overall regulator formed by the combination of balance wheels in resonance would thus exhibit, on average, a more accurate and reliable operation overall than that of each individual constituent balance wheel. This solution is based on a theoretical approach. However, the practical application thereof poses technical problems, which have not been overcome. Specifically, in order to obtain the stable operation of the various balance wheels in resonance, it is necessary for these balance wheels to be endowed with the same oscillatory properties, i.e. preferably identical in terms of weight, geometry and adjustment of operation, and to be subject at any time to exactly the same external influences. Since these conditions are rarely met, the resonance principle has not been able to provide the expected results for time measurement in the prior art.

Document WO2014180767 thus proposes a simplified, more efficient solution based on multiple balance wheels operating in resonance. In practice, it nonetheless remains complex to achieve resonance between balance wheels and to attain the theoretical advantages that such a solution could provide.

Thus, the general object of the invention is to propose a time measurement solution for a timepiece which does not comprise any or some of the drawbacks of the solutions of the prior art.

More specifically, a first object of the invention is to propose a time measurement solution allowing a high level of accuracy to be achieved, in particular for use within a wristwatch, in particular allowing the deleterious effect of gravity on the isochronism of the watch to be greatly decreased or even negated.

A second object of the invention is to propose a compact time measurement solution that is compatible with use within a watch, in particular a wristwatch.

BRIEF DESCRIPTION OF THE INVENTION

To this end, the invention is based on an oscillating regulator for a timepiece, comprising an oscillating regulator for a timepiece, wherein it comprises at least two resonant oscillating systems, each comprising at least one magnetic component suitable for exchanging magnetic energy during the oscillations thereof and wherein the axes of at least two oscillating systems have different orientations.

The term "magnetic component" is understood to mean a component that is sensitive to a magnetic field: this may be either a component, referred to as a magnetized component, such as a permanent or non-permanent magnet, i.e. a component that generates a substantial proper magnetic field, or a component, referred to as a magnetizable component, i.e. a component that retains almost no proper magnetic field after excitation, i.e. as is the case with the materials referred to as soft ferromagnetic materials, for example.

The oscillating regulator for a timepiece may comprise a primary oscillating system, exerting a magnetic force on at least one other secondary oscillating system, each secondary oscillating system being such that two secondary oscillating systems exert no, or almost no, magnetic force on one another.

The primary oscillating system may comprise at least one magnetic component comprising a magnetized component, in particular a magnet, and the at least one secondary oscillating system may comprise a magnetic component made of magnetizable material.

The oscillating regulator for a timepiece may comprise three, or an odd number greater than three, resonant oscillating systems of different orientations.

All of the oscillating systems may be distributed equally about a center axis.

The oscillating regulator may comprise at least one platform linking all of the oscillating systems to one another.

The axis of rotation of each oscillating system may be mounted on one and the same platform such that each oscillating system is solely capable of a rotary movement with respect to this platform.

The oscillating systems may all be of the same type, in particular of balance wheel/hairspring or pendulum type.

The oscillating systems may be of balance wheel/hairspring type and a magnetic component may be:

- a weight fastened to the felloe of the balance wheel/hairspring, in particular fastened by being driven into place, or by bonding, welding, riveting or bolting; and/or
- a magnetized or magnetizable component of the balance wheel/hairspring.

The axes of rotation of each of the oscillating systems thereof may be oriented at an angle smaller than or equal to 60 degrees with respect to a center axis, or the axes of rotation of each of the oscillating systems thereof may be mounted on contiguous faces of a cube.

The invention also pertains to a timepiece movement, wherein it comprises an oscillating regulator such as described above.

The timepiece movement may comprise a power source and a wheel train for transmitting power from the power source to a single primary oscillating system, the magnetic components of which exert a magnetic force on each other secondary oscillating system of the regulator.

The secondary oscillating systems of the oscillating regulator may exert no, or almost no, magnetic force on one another.

The invention also pertains to a timepiece, in particular a watch or wristwatch, wherein it comprises an oscillating regulator such as described above or a timepiece movement such as described above.

The timepiece may comprise a dial and the oscillating systems of the oscillating regulator may be distributed equally about a center axis that is substantially perpendicular to the dial.

The invention also pertains to a watch that comprises a single power source, linked to a single primary oscillating system of the oscillating regulator by one or more wheel trains.

The invention also pertains to a method for measuring time on the basis of an oscillating regulator, wherein it comprises the following steps:

- transmission of power from a power source to a primary oscillating system of the oscillating regulator; and
- transmission of magnetic energy from the primary oscillating system to at least one secondary oscillating system.

BRIEF DESCRIPTION OF THE FIGURES

These objects, features and advantages of the present invention will be described in detail in the following non-limiting description of one particular embodiment provided with reference to the appended figures, in which.

The principal implemented in the embodiment that will be described below depends on the use of multiple balance wheels operating in resonance via mutual exchange of magnetic energy and on the use of at least two balance wheels of different orientation, in order to attain a regulator solution that will simply be qualified as a regulator with three-dimensional resonance.

Figure 1:
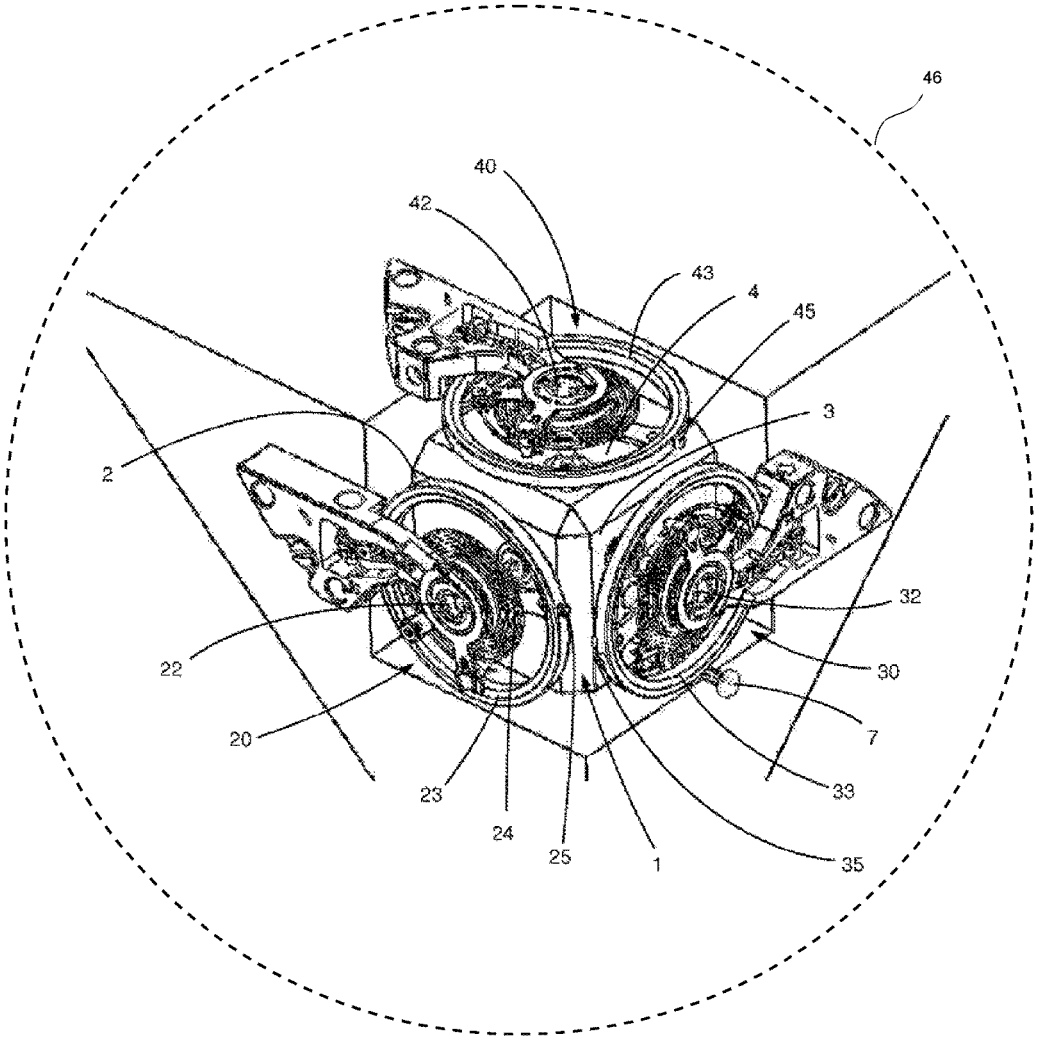
FIG. 1 shows a simplified perspective view of an oscillating regulator according to one embodiment of the invention.

FIG. 1 thus shows an oscillating regulator with three-dimensional resonance according to one embodiment, which comprises a platform 1 forming a pyramid, on which three oscillating systems 20, 30, 40, operating in resonance, of balance wheel/hairspring type in this embodiment, are arranged. The platform 1 is fixed with respect to the plate bearing the other components of the timepiece movement.

The platform 1 takes the form of a cube or a portion of a cube, of which three adjacent faces, which are perpendicular to one another, form surfaces 2, 3, 4 bearing each of the three identical oscillating systems, respectively.

In this embodiment, each oscillating system 20, 30, 40 is of balance wheel/hairspring type. The first balance wheel/hairspring is arranged about an axis of rotation 22, which is mounted perpendicularly to the surface 2. This oscillating system additionally comprises, in a known manner, a balance wheel comprising a felloe 23 acting as a flywheel, mounted rotatably about the axis of rotation 22, via a spiral spring simply referred to as the hairspring 24. The balance wheel/hairspring is commonly used in the field of horology and will not be described in greater detail here. Similarly, two other assemblies of balance wheel/hairspring type are arranged about axes of rotation 32, 42, which are arranged on the surfaces 3, 4 of the platform 1, respectively, and form two other oscillating systems of the regulator.

Thus, in this embodiment, the oscillating regulator is composed of three complementary oscillating systems, which all have different orientations. In the proposed embodiment, these orientations are perpendicular to one another.

As a variant, the oscillating systems may be mounted on three faces of a non-cubic pyramid, having non-perpendicular faces. This pyramid may have a center axis and the three oscillating systems may be positioned on three planes of the pyramid distributed uniformly about this center axis. According to the advantageous variant described above, the three oscillating systems are arranged on three contiguous faces of a cube, i.e. the surfaces 2, 3, 4 are perpendicular to one another and coincide with the three faces of a cube. As another variant, these surfaces could coincide with certain surfaces of a regular, not necessarily cubic, polyhedron.

The oscillating systems of the oscillating regulator may be distributed equally about a center axis that is substantially perpendicular to a dial of the timepiece, as shown schematically by the outline of dial 46 on FIG. 1.

It should be noted that one technical problem of such a configuration of an oscillating regulator with three-dimensional resonance arises from the necessary bulk due to the use of multiple oscillating systems and the arrangement thereof in three spatial dimensions. To this end, one technical solution consists in minimizing the overall height of the regulator. In order to achieve this, the surfaces 2, 3, 4 may be slightly inclined with respect to one another, i.e. the axes of rotation 22, 32, 42 of the oscillating systems preferably have angles that are smaller than or equal to 60 degrees, or even smaller than or equal to 50 degrees.

The regulator according to the embodiment comprises a particular oscillating system 30, referred to as the primary operating system, associated, in a timepiece movement (not shown), with a conventional power distribution system, which allows for example energy pulses to be transmitted to a single escapement wheel 7, via an anchor for example, for the purpose of sustaining the oscillations thereof, in a known manner.

Figure 2:
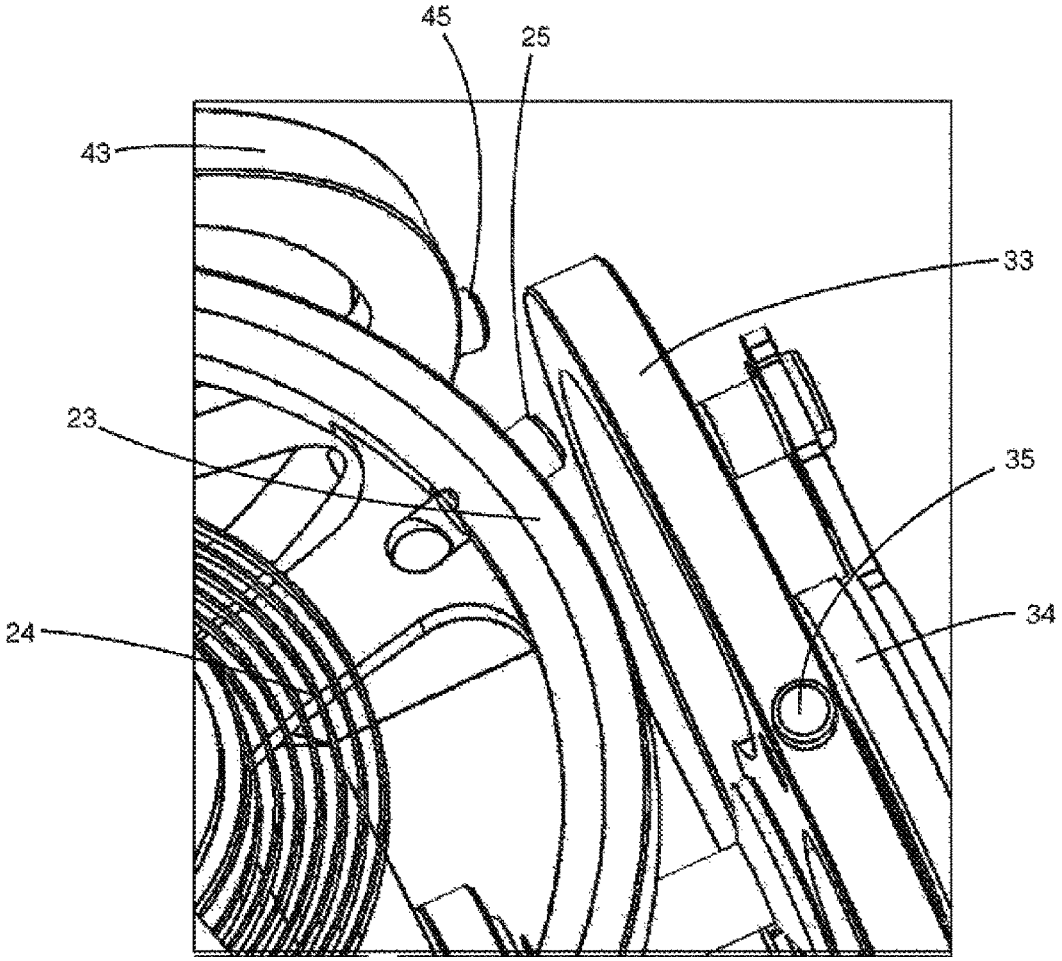
FIG. 2 shows a view from below of the oscillating regulator according to the embodiment of the invention.

This primary oscillating system 30 is provided with magnetic components 35, which can be seen more particularly in FIG. 2. In the embodiment shown, two small magnetic weights are fastened to the felloe 33 at 180 degrees about the axis 32 in order to provide the felloe with a dynamic equilibrium. Similarly, the two other oscillating systems, referred to as the secondary oscillating systems, are also provided with magnetic components 25, 45. In this embodiment, these magnetic components are likewise two magnetic weights distributed equally on the felloe 23, 43 of the balance wheels thereof. Thus, the three (one primary and two secondary) oscillating systems have the same structure, including magnetic components suitable for exchanging magnetic energy.

Figure 3:
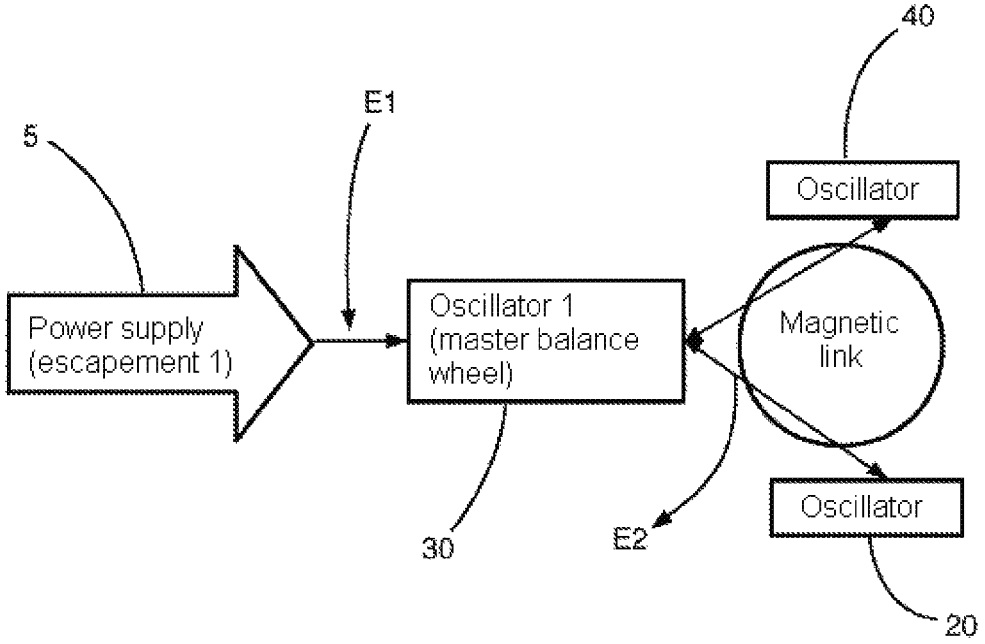
FIG. 3 shows a side view of the oscillating regulator according to the embodiment of the invention.

The operation of this regulator will now be described with reference to FIG. 3, which shows a block diagram. The primary oscillating system 30 is driven by the motor of the timepiece movement, for example a mainspring, in a conventional manner. It should be noted that this motor forms a power source 5. The timepiece movement advantageously comprises a single power source, and comprises, for example, a single barrel. In the oscillating movement of the primary oscillating system, the magnetic components 35 thereof travel a repeating path. On this path, they exert tangential repulsive forces on the magnetic components 25, 45 of the two secondary oscillating systems 20, 40, respectively. The effect of this exerted magnetic force is to transmit periodic pulses to these secondary oscillating systems, which thus causes them to oscillate stably by virtue of the magnetic energy transmitted by the primary oscillating system 30 and indirectly by the single power source 5 of the timepiece movement. FIG. 3 summarizes this operation, and likewise describes a method of operation of a timepiece movement regulator:

- in a first step E1, a power source 5 transmits pulses to a primary oscillating system 30; and
- in a second step E2, the primary oscillating system 30 transmits magnetic energy to two secondary oscillating systems 20, 40.

The result of this is that a single power source directly and indirectly sets in motion the three oscillating systems oriented along the three spatial axes.

It should be noted that the secondary oscillating systems 20, 40 are independent of one another. In particular, the magnetic components 25, 45 thereof exert no force (or negligible force) on one another. To achieve this, the magnetic components 35 of the primary oscillating system 30 are permanent magnets, more simply referred to as magnets, while the magnetic components 25, 45 of the secondary oscillating systems 20, 40 are simple magnetizable elements, which are sensitive to the magnetic field exerted by the magnets of the primary oscillating system but exert almost no force on one another.

As a variant, the magnetic components 25, 45 of the secondary oscillating systems are positioned so as to be offset by 90 degrees on the respective felloe 23, 43 thereof, such that during the oscillations thereof, which are in phase due to the resonance phenomenon which will be described below, when one thereof is located in the closest possible position to the felloe of the other secondary oscillator, the magnetic components of this other felloe are located in a position far away from this magnetic component, preferably the position that is furthest away, of the order of 90 degrees from this position.

Of course, the embodiment has been described by way of non-limiting example, and numerous possible variants exist for the magnetic components of each oscillating system. In particular, it would be possible as a variant to have only one magnetic weight per felloe, or, according to another variant, at least three magnetic weights. Preferably, these weights are distributed uniformly on the oscillating system.

Each magnetic component of a secondary oscillating system may be made of a magnetizable material of ferromagnetic type, for example a disk of soft iron coated with a corrosion-resistant layer, for example nickel.

Each magnetic component may take the form of a magnetic cylinder, fastened in a hole made in the felloe of an oscillating system. As a variant, the magnetic component may take another form.

It may be fastened to the oscillating system by being driven into place, or by bonding, welding or riveting into a socket. The latter may be movably mounted on the oscillating system, in particular by screwing by virtue of threading made in the rim thereof. As a variant, the magnetic component may comprise a threaded zone so that it can be fastened by screwing into a corresponding threaded opening of the oscillating system. It should be noted that, in the case of screw fastening, it is possible to make fine adjustments to the oscillating system by modifying the screw turns.

In the embodiment shown, each cylinder-shaped magnetic component extends in a direction perpendicular to the axis of rotation of the oscillating system. As a variant, the magnetic component could be fastened in another orientation, for example parallel to this axis of rotation.

As a variant, all or a portion of the oscillating system is directly formed in a magnetized material, such that it is no longer necessary to add additional magnets such as the weights described above. Thus, a magnetic component may be formed directly by a component of the oscillating system itself, for example a portion or the entirety of the felloe.

In the embodiment described, the magnetic components exert repulsive forces on one another in order to transfer magnetic energy from a primary oscillating system to another secondary oscillating system. As a variant (not shown), this force could be an attractive magnetic force.

The three oscillating systems 20, 30, 40 of this embodiment are of the same nature, having the same oscillating geometries. They will naturally tend toward coherent oscillations that are in phase by virtue of the phenomenon referred to as resonance in the prior art. The primary oscillating system 30 will share a portion of its received energy with two secondary oscillating systems 20, 40, via a transmission of magnetic energy such as described above, and this architecture will automatically cause the three oscillators 20, 30, 40 to oscillate in phase by virtue of the resonance phenomenon.

In order to optimize this resonance and the efficiency thereof, a deliberate choice was made to have at least two oscillating systems in resonance oriented differently, thereby giving them a greater chance of resisting deleterious external influences. In particular, this configuration allows the regulator to be less dependent on the effect of the force of gravity and to have an operation that is less dependent on the orientation thereof, which is particularly advantageous in an implementation within a wristwatch case. Specifically, when the axis of a first oscillating system of the regulator is oriented in an unfavorable direction, increasing friction and resistance to its natural oscillation, in particular for example when the balance wheel thereof is located in a perpendicular direction (i.e. the axis of rotation thereof is horizontal), at least one other oscillating system will not be in this unfavorable direction. The influence of this other oscillating system on the first oscillating system will counter the deleterious influence of the force of gravity and the result obtained at the output of the regulator will be both more accurate than if there were only the first oscillating system and more stable, since it is less dependent on the orientation of the regulator. For example, in the chosen embodiment, when a balance wheel is in a vertical position, in which gravity generally upsets its ideal operation, at least one other balance wheel will be in a non-vertical position, and preferably close to the horizontal, so as to benefit from an operation that is less, or even not at all, disrupted by gravity. In any case, when gravity alters the operation of one of the balance wheels, it will not alter that of the other balance wheels in the same manner: the average outcome resulting from the resonance between the various balance wheels thus remains relatively insensitive to gravity. Thus, the regulator used implements a three-dimensional resonance solution, through the choice of at least two oscillating systems operating in resonance and having different orientations. This three-dimensional resonance makes it possible to achieve a result that is surprisingly more accurate than any of the other resonance solutions previously attempted in the prior art.

In the embodiment shown, the regulator comprises three oscillating systems. Other embodiments may be obtained by choosing any other number of oscillating systems, as long as there are at least two, as mentioned above. However, as seen, at least two of the oscillating systems should have different orientations. Preferably, all of the oscillating systems will have different orientations, and will be distributed uniformly in space so as to optimize the non-dependence thereof with regard to the orientation of the regulator. For example, the axes of rotation thereof may be distributed equally about a certain axis. Complementarily, the main components of the oscillating systems, such as a balance wheel, a hairspring, a pendulum, etc., may also be distributed uniformly about this same axis. However, it would also be advantageous to make provision for an odd number of oscillating systems, such as three or even five, which represents the best trade-off between performance and simplicity. Regardless of the number of oscillating systems, there will be a single primary system, all of the others being secondary, receiving magnetic energy from the first and being mutually independent.

As a variant embodiment, it would be possible to have more than just one primary system, for example two or more primary systems.

The oscillating systems selected in the embodiment described are of balance wheel/hairspring type. Of course, any other oscillating system may be used as a variant, such as pendulum-based oscillating systems. Each oscillating system is adjustable, so as to determine the ideal adjustments for the operation in resonance thereof.

The oscillating systems are linked to one another via one or, as a variant, two platforms, on which one or more ends of the axes thereof are mounted. In the embodiment, all of the balance wheels are endowed with a balance bridge (cock) provided with an index system allowing each of the hairsprings to be adjusted independently. These platforms and the oscillating systems can therefore then form a compact and rigidly mechanically linked assembly, allowing mechanical energy to be transmitted between the oscillating systems in addition to the transmission of magnetic energy described, favoring resonance between these various systems. The regulator assembly has its own oscillating property, a proper oscillation frequency, referred to as the resonance frequency.

It is thus advantageous to use a platform taking the form of a single, monolithic part, and providing an arrangement where the distance between the various oscillating systems is insubstantial. Furthermore, the platform will advantageously be made in a material having favorable vibratory properties, such as brass, a noble metal, etc. As a variant, a platform could be composed of separate portions fastened to one another. Certain ends of oscillating systems could be linked to a platform and other ends could remain free. Not all of the oscillating systems of the regulator are necessarily linked to one and the same platform. Lastly, a specific, dedicated platform has been provided in the embodiment. However, as a variant, the platform function may be carried out by a component of the timepiece such as a plate, a dial, a bridge, etc. Of course, the oscillating systems may be positioned on separate and independent platforms, or mounted in any manner in proximity to one another, the magnetic components sufficing to set them in resonance. It is sufficient that in the oscillations thereof, magnetic components travel a trajectory such that they pass in proximity in order to exert a pulse on one another as required and sufficient for the oscillatory motion of the secondary oscillating systems.

Advantageously, besides the magnetic components, a portion, or even the entirety, of the other elements forming the timepiece movement are made in materials that are relatively insensitive to magnetic fields.

It is apparent that the chosen solution is very simple, in particular in comparison with the complex systems of tourbillon type. In the embodiments described, each oscillating system is solely rotatably movable about the axis of rotation thereof with respect to the rest of the watch, in particular with respect to one or more platforms of the watch to which it is linked. Thus, the axis of rotation of each oscillating system is fixed with respect to the timepiece movement or the watch.

The geometry of the platform 1 has been described by way of non-limiting example. It could of course take any other shape, be formed from multiple surfaces which are not necessarily planar, but curved, or even from a single curved surface, as long as it allows at least two oscillating systems to be assembled with different orientations. The planes that are perpendicular to the axes of the various oscillating systems may thus form a portion of an irregular polyhedron, i.e. certain surfaces of an irregular polyhedron could be perpendicular to the axes of rotation of the oscillating systems of the regulator.

The regulator described above performs particularly well within a wristwatch. Of course, it is also more broadly of use for any implementation within any timepiece movement, for any timepiece.

In addition, the absence of mechanical link between the oscillating systems facilitates adjustment and therefore improves the accuracy of the regulator.

Furthermore, the principle of the regulator with three-dimensional resonance is compatible with other approaches allowing the accuracy of the regulator to be improved. Thus, it may, for example, be combined with a solution of tourbillon type. Lastly, the regulator with three-dimensional resonance makes it possible to decrease greatly, or even negate, the deleterious effect of gravity and more generally of the various defects of the oscillating systems on the isochronism of the watch.

The invention claimed is:

1. An oscillating regulator for a timepiece, comprising three, or an odd number greater than three, resonant oscillating systems of different orientations, the resonant oscillating systems including a primary oscillating system and at least two secondary oscillating systems, each comprising a magnetic component suitable for exchanging magnetic energy during oscillations thereof, wherein axes of rotation of the oscillating systems have different orientations, wherein the magnetic component of the primary oscillating system exerts a magnetic force on each of the magnetic components of the secondary oscillating systems, and wherein the magnetic component of each of the magnetic components of the secondary oscillating systems is sensitive to the magnetic force of the magnetic component of the primary oscillating system but is not capable of exerting any substantial magnetic force on any of the other oscillating systems.

2. The oscillating regulator for a timepiece as claimed in claim 1, wherein the at least one magnetic component of the primary oscillating system comprises a magnet and wherein the magnetic component of each of the secondary oscillating systems is made of magnetizable material.

3. The oscillating regulator for a timepiece as claimed in claim 1, wherein the magnetic component of the primary oscillating system is a magnetized component that generates a substantial magnetic field, and the magnetic component of each of the secondary oscillating systems is a magnetizable component that retains substantially no magnetic field after excitation.

4. The oscillating regulator for a timepiece as claimed in claim 1, wherein all the oscillating systems are distributed equally about a center axis.

5. The oscillating regulator for a timepiece as claimed in claim 1, comprising at least one platform linking all the oscillating systems to one another.

6. The oscillating regulator for a timepiece as claimed in claim 5, wherein the axis of rotation of each of the oscillating systems is mounted on one and the same platform so that each of the oscillating systems is solely capable of a rotary movement with respect to the platform.

7. The oscillating regulator for a timepiece as claimed in claim 1, wherein the oscillating systems are all balance wheel-hairspring oscillating systems, and wherein a magnetic component of each of the oscillating systems is at least one of:

a weight fastened to the felloe of the balance wheel-hairspring; and a magnetized or magnetizable component of the balance wheel-hairspring.

8. The oscillating regulator for a timepiece as claimed in claim 7, wherein the oscillating systems are all balance wheel-hairspring oscillating systems, and wherein a magnetic component of each of the oscillating systems is a weight fastened to the felloe of the balance wheel-hairspring by being driven into place, or by bonding, welding, riveting or bolting.

9. The oscillating regulator for a timepiece as claimed in claim 1, wherein the axes of rotation of each of the oscillating systems are oriented at an angle smaller than or equal to 60 degrees with respect to a center axis, or wherein the axes of rotation of each of the oscillating systems thereof are mounted on contiguous faces of a cube.

10. A timepiece movement comprising the oscillating regulator as claimed in claim 1.

11. The timepiece movement as claimed in claim 10, wherein the timepiece movement comprises a power source and a wheel train configured for transmitting power from the power source to the single primary oscillating system and not to the at least one secondary oscillating system.

12. A timepiece comprising the oscillating regulator as claimed in claim 1.

13. The timepiece as claimed in claim 12, comprising a dial and wherein the oscillating systems of the oscillating regulator are distributed equally about a center axis that is substantially perpendicular to the dial.

14. The timepiece as claimed in claim 12, comprising a single power source, linked to a single primary oscillating system among the oscillating systems of the oscillating regulator by one or more wheel trains.

15. A method for measuring time on the basis of the oscillating regulator as claimed in claim 1, wherein the method comprises:

transmitting power from a power source to a primary oscillating system among the oscillating systems of the oscillating regulator; and transmitting magnetic energy from the primary oscillating system to at least one secondary oscillating system among the oscillating systems of the oscillating regulator.

16. A watch or wristwatch comprising the oscillating regulator as claimed in claim 1.

17. The oscillating regulator for a timepiece as claimed in claim 1, wherein the oscillating systems are either (i) all balance wheel-hairspring oscillating systems or (ii) all pendulum oscillating systems.

* * * * *